US010383385B2

(12) United States Patent
Moreau et al.

(10) Patent No.: US 10,383,385 B2
(45) Date of Patent: Aug. 20, 2019

(54) TETHER CLIP AND METHOD OF TETHERING HARD HATS

(71) Applicant: Ty-Flot, Inc., Manchester, NH (US)

(72) Inventors: Darrell A. Moreau, Manchester, NH (US); Andre W. Moreau, Bedford, NH (US)

(73) Assignee: Ty-Flot, Inc., Manchester, NH (US)

( * ) Notice: Subject to any disclaimer, the term of this patent is extended or adjusted under 35 U.S.C. 154(b) by 464 days.

(21) Appl. No.: 15/065,942

(22) Filed: Mar. 10, 2016

(65) Prior Publication Data

US 2016/0183620 A1 Jun. 30, 2016

Related U.S. Application Data

(63) Continuation-in-part of application No. 14/552,966, filed on Nov. 25, 2014, now Pat. No. 9,756,890.

(51) Int. Cl.

| | |
|---|---|
| ***A42B 3/04*** | (2006.01) |
| ***A42B 3/08*** | (2006.01) |
| ***A44B 13/00*** | (2006.01) |

(52) U.S. Cl.

CPC ..... *A42B 3/08* (2013.01); *A42B 3/04* (2013.01); *A44B 13/00* (2013.01); *A44B 13/0029* (2013.01)

(58) Field of Classification Search

CPC .... A42B 3/04; A42B 3/08; A42B 1/02; A42B 1/08; A42B 3/00; A42B 3/006; A42B 3/0406; A42B 3/0413; A42B 3/085; A42B 7/00; A42B 3/0473; A44B 13/00; A44B 13/0029; A44B 11/12; A44B 11/2526;

(Continued)

(56) References Cited

U.S. PATENT DOCUMENTS

| | | | | |
|---|---|---|---|---|
| 701,639 A | | 6/1902 | Stamm | |
| 1,406,622 A | * | 2/1922 | Donlin | A42B 7/00 2/175.7 |

(Continued)

OTHER PUBLICATIONS

Amazon Listing for Squids 3155 Clamp Hard Hat Lanyard, retrieved at https://www.amazon.com/Squids-3155-Clamp-Hard-Lanyard/dp/B005S38WPO/ref=sr_1_7?ie=UTF8&qid=1529426651&sr=8-7&keywords=hard+hat+tether&dpID=31bj3VjIIOL&preST=_SX300_QL70_&dpSrc=srchie=UTF8&reviewerType=all_reviews&formatType=current_format&pageNumber=1 on Jun. 19, 2018 containing c.*

(Continued)

*Primary Examiner* — Anna K Kinsaul
*Assistant Examiner* — F Griffin Hall
(74) *Attorney, Agent, or Firm* — Dicke, Billig & Czaja, PLLC

(57) ABSTRACT

A method of storing a hard hat tether attached to a hard hat includes the steps of providing a hard hat; providing a clip holder having a latch plate with a latch opening that defines at least one attachment handle; providing a clip member defining a tether opening and having a locking mechanism constructed to removably secure the clip member to the clip holder by capturing the attachment handle; providing a hard hat tether having a first tether end portion secured to the clip member by extending through the tether opening of the clip member, a second tether end portion, and a tether body portion secured to the clip holder; securing the second tether end portion to the hard hat; and attaching the clip member to the attachment handle of the clip holder, thereby storing the clip member.

15 Claims, 10 Drawing Sheets

(58) Field of Classification Search
CPC ..... A44B 11/2549; Y10T 24/4016; Y10T 24/4077
USPC ..... 2/410, 6.2, 421, 422, 175.7, 175.3
See application file for complete search history.

(56) References Cited

U.S. PATENT DOCUMENTS

| | | | | | |
|---|---|---|---|---|---|
| 1,782,057 | A * | 11/1930 | Bollinger | A41F 19/005 | 2/323 |
| 3,273,163 | A * | 9/1966 | Andrews, III | A42B 3/04 | 2/422 |
| 4,391,000 | A * | 7/1983 | Lonnstedt | A42B 3/04 | 2/209 |
| 4,442,551 | A * | 4/1984 | Hellberg | A42B 3/225 | 2/10 |
| 4,479,738 | A * | 10/1984 | Kubnick | A42B 3/04 | 2/10 |
| 4,764,989 | A * | 8/1988 | Bourgeois | A42B 3/185 | 2/10 |
| 4,991,236 | A | 2/1991 | Pritchett | | |
| 5,658,065 | A * | 8/1997 | Jamieson | A42B 3/04 | 2/422 |
| 5,675,841 | A | 10/1997 | Jackson | | |
| 6,154,887 | A | 12/2000 | Yagi | | |
| 6,616,294 | B1 * | 9/2003 | Henry | A42B 3/04 | 2/422 |
| 6,648,101 | B2 * | 11/2003 | Kurtgis | A62B 35/0075 | 182/145 |
| 8,117,678 | B2 * | 2/2012 | Moreau | A42B 3/04 | 2/410 |
| 8,191,292 | B2 * | 6/2012 | Cummings | A42B 3/0406 | 2/209.13 |
| D683,653 | S * | 6/2013 | Moreau | D11/215 | |
| 8,622,593 | B2 * | 1/2014 | Cristoforo | A42B 3/044 | 362/396 |
| D699,100 | S * | 2/2014 | Moreau | D8/394 | |
| D741,554 | S * | 10/2015 | Moreau | D29/122 | |
| D763,673 | S * | 8/2016 | Moreau | D8/395 | |
| D778,508 | S * | 2/2017 | Moreau | D29/122 | |
| 2002/0008125 | A1 * | 1/2002 | Caputi | A45C 13/30 | 224/257 |
| 2004/0068779 | A1 * | 4/2004 | Duffy | A42B 3/0473 | 2/422 |
| 2010/0012692 | A1 | 1/2010 | Harris | | |
| 2010/0064405 | A1 | 3/2010 | McGovern | | |
| 2011/0113529 | A1 * | 5/2011 | Milioto | A42B 1/24 | 2/209.13 |
| 2013/0180033 | A1 * | 7/2013 | Uemoto | A42B 3/30 | 2/410 |
| 2014/0201888 | A1 * | 7/2014 | Bookbinder | A42B 7/00 | 2/338 |
| 2017/0119138 | A1 * | 5/2017 | Moreau | A45F 5/02 | |

OTHER PUBLICATIONS

Amazon Listing for Squids 3155 Clamp Hard Hat Lanyard, retrieved at https://www.amazon.com/Squids-3155-Clamp-Hard-Lanyard/ (see actual attachment for full link) on Jun. 19, 2018.*

Notice of Allowance for U.S. Appl. No. 14/552,966 dated Jun. 7, 2017; 14 pages.

Non-Final Office Action for U.S. Appl. No. 14/552,966 dated Mar. 6, 2017; 20 pages.

Final Office Action for U.S. Appl. No. 14/552,966 dated Aug. 16, 2016; 20 pages.

Non-Final Office Action for U.S. Appl. No. 14/552,966 dated Apr. 14, 2016; 19 pages.

Restriction Requirement for U.S. Appl. No. 14/552,966 dated Feb. 8, 2016; 7 pages.

* cited by examiner

TETHER CLIP AND METHOD OF TETHERING HARD HATS

BACKGROUND OF THE INVENTION

1. Field of the Invention

The present invention relates generally to accessories for hard hats and drop-prevention devices. Particularly, the present invention relates to a tether clip for hard hats.

2. Description of the Prior Art

Hard hats are a mandatory safety item used in or around electrical power plants, chemical plants, construction sites, warehouses, and other industrial sites. Their use is mandated through safety programs and addresses overhead hazards present in these industries. Hard hats are intended to be a type of safety equipment that will protect the wearer from overhead hazards as well as from bumping one's head in areas of low clearance.

A conventional hard hat is shown in FIGS. 1 and 2. FIG. 1 shows a perspective view of an example of a hard hat 300 as is known in the art. Hard hat 300 includes a cap portion 301 with a brim 302, which are typically made of high-density polyethylene. Along the sides of the cap portion 301 and adjacent brim 302, hard hat 300 has a pair of oppositely positioned universal accessory slots 310 (only one is visible) where each accessory slot 310 has an accessory slot opening 312 between a first slot wall 314 and a second slot wall 316 that opposes and is spaced apart from first slot wall 314. Typically, accessory slot opening 312 has a length 312*a* of about three centimeters and a width 312*b* of about three millimeters.

FIG. 2 illustrates a bottom plan view of the hard hat shown in FIG. 1. Accessory slot openings 312 extend through brim 302. These accessory slots 310 are used for attaching face shields, flashlights, hearing protection, and other accessories, where the accessory includes a tab or plate that inserts and locks into accessory slots 310.

In some cases, the hard hat is considered a hazard itself. For instance, in most industrial work sites where overhead work is being performed, workers are typically wearing a hard hat. If a worker leans over or bumps his/her head, the hard hat may fall off the wearer's head. The falling hard hat can become a drop hazard to personnel or vital plant equipment below.

In other cases, such as at nuclear power plants, workers often will work from a bridge crane that straddles a reactor vessel filled with water. If the hard hat falls off the worker, it may land in the pool of water. If the hard hat cannot be retrieved before it sinks, then the retrieval process may be time consuming and very costly. Typically, a nuclear power plant will lose approximately $100,000 per hour of down time during a refueling or maintenance outage. Depending on where the hat comes to rest, it could take several hours to retrieve the hard hat and consequently delay the plant from coming back online.

A chin strap used with a hard hat is one method to keep the hard hat on a wearer's head. However this method can be uncomfortable and cumbersome. Also, hard hat chin straps used in contaminated environments may become contaminated themselves since the strap is usually made of fabric that absorbs or retains liquids and particle contaminants. For this reason, items in direct contact with exposed skin require frequent cleaning prior to donning. However, hard hats are not typically laundered, even those with chin straps.

U.S. Pat. No. 701,639 (1902, Stamm) discloses a hat guard device that prevents a straw hat from blowing away.

The device includes a cord, a flat tapering pin attached to one end of the cord, and a clamping device secured at the opposite end of the cord provided with two openings or eyes and a V-shaped clamping hook. The tapering pin is adapted to be pierced through the body of the hat near the brim. The cord passes through the eyes and is knotted to secure it. When the hat is not in use, the cord is tightly wrapped around the body of the hat and the clamping hook is hooked on the cord and bites into the cord to firmly retain the clamping device in position. When the hat is in use, the V-shaped clamping hook is released from the cord and passed through a lapel button hole of a coat and fastened as desired.

U.S. Pat. No. 4,991,236 (1991, Pritchett) discloses a hat retaining device with a cord that attaches at one end to a hat with an alligator clip or suspenders clip. The other end of the cord defines a loop sized to be worn around the wearer's neck.

U.S. Pat. No. 6,154,887 (2000, Yagi) discloses a hat and retaining device to prevent the hat from blowing away in windy conditions. The retaining device has a cloth string with a first end fixed to the top button of a crown of a baseball cap. In one embodiment, the first end of the cloth string is passed through a grommet in the hat and then knotted to prevent its release. In another embodiment, the first end of the cloth string is secured by sewing to cloth tape attached along seams of the crown.

U.S. Pat. No. 8,117,678 (2012, Moreau et al.) discloses a hard hat lanyard in combination with a hard hat that includes a strap with a first end and a second end. The first end is secured to a fastening mechanism that wraps around a hard hat inner brim. Alternately, a button snap is secured to the first end of the strap and is adapted to fastening to a mating snap on the hard hat cap portion. A fastening mechanism, such as a clip, is fastened to the second end is adapted to be secured to an article of clothing.

SUMMARY OF THE INVENTION

The hat retention devices of the prior art have deficiencies that have not been fully addressed for hard hats. The Stamm hat guard is acceptable for straw hats and other hats made of a flexible material. However, one cannot insert a hook into the brim of a hard hat because the hard hat material is inflexible. Also, hard hats typically have a domed cap portion that extends over the wearer's head, rather than a cylindrical body, so a cord wrapped around the outside of the cap portion would tend to slip off. Further, the weight of a hard hat would pull the clamping device through a lapel button hole. Furthermore, industrial workers are unlikely to wear jackets having lapel button holes.

The Yagi hat retention device is unsuitable for use with a hard hat because it would require modifying standard safety equipment made to a particular standard. This is because the Yagi device is intended to be stitched into cloth strips along seams of the hat or passed through an eyelet in cloth hats. Since a hard hat lacks these features, the Yagi device is not usable with a hard hat.

The Pritchett retaining cord would be unsuitable for use with a hard hat because of the danger of attaching a loop around the wearer's neck when working in an industrial environment. Also, an alligator clip or suspenders clip does not firmly grasp the plastic brim of a hard hat since the hard hat is not pliable.

The Moreau et al. hard hat tether relies on a cord that loops around the suspension system of the hard hat. A cord that attaches to the hard hat with a snap button requires that the hat include a mating snap that provides a strong coupling to prevent unintentional release of the snap and snap button.

In addition to the deficiencies mentioned above, none of the prior art hat retention devices provides a storage location for a hard hat tether when the second end is not attached to the wearer. For some tethers, the first end of the hat-end of the tether is permanently or semi-permanently secured to the hard hat, such as by being looped through a chin-strap opening of the hard hat. The second end of the tether may have a clip member that can be secured to clothing to tether the hard hat to the wearer. However, when storing the hard hat and when using the hard hat in situations where the tether is not needed, the wearer often clamps the clip member to the brim of the hard hat. Due to the brim's thickness and hardness, when the clip member is made of metal, clamping the clip member to the brim bends the clip member and it no longer securely clamps to clothing as intended. When the clip member is made of plastic, clamping the clip member to the brim stretches or deforms the clip member and weakens its grip when clamping it to clothing. In either case, the user needs a different location to stow the clip member to prevent degrading or ruining the ability of the clip member to attach securely to clothing or the like.

Therefore, what is needed is a device that provides a storage option for the hard hat tether when the tether is not used to tether the hat to the wearer's person.

It is an object of the present invention to provide a device that enables the wearer of a hard hat to stow the unused end of hard hat tether out of the way when the tether is not used to tether the hard hat to the wearer.

The present invention achieves this and other objectives by providing a clip holder for use with a hard hat and a clip member adapted for connecting on one end to the clip holder and, on the other end, to a hard hat tether. In one embodiment, the clip holder includes a clip holder body having a proximal body end portion and a distal body end portion, a front face, and a rear face. The clip holder body includes a resilient tab protruding in a first direction away from the front face of the clip holder body and a lip extending from the proximal body end portion in a second direction away from the rear face of the clip holder body and defining a catch surface facing towards the distal body end portion, where the second direction is generally opposite of the first direction. The clip holder body is plate-like and sized to be received through the universal accessory slot of the hard hat with the resilient tab abutting a first slot wall and the lip overlapping the slot rim. A latch plate adjoins and extends distally from the distal body end portion of the clip holder body. The latch plate has a latch opening extending therethrough and defining an attachment handle.

In another embodiment, the latch plate and the clip holder body define an angle therebetween from about 120° to 180°.

In another embodiment, the resilient tab includes a tab body connected to the clip holder body and extending transversely from the plate-like body to a distal tab portion, wherein the resilient tab defines a gap between the distal tab portion and the front face of the clip holder body thereby permitting the resilient tab to flex towards the front face.

In another embodiment, the clip holder body has a substantially U-shaped opening defining a tab body connected to the clip holder body at a proximal tab end and extending to a distal tab end portion. The tab body includes a tab protrusion connected to the distal tab end portion and extending in the first direction beyond the front face.

In some embodiments, when the clip holder body is installed in the universal accessory slot, the resilient tab abuts the first slot wall, thereby biasing the clip holder body towards the second slot wall and biasing the lip to overlap the slot rim along the universal accessory slot.

In another embodiment, the clip holder body has an arcuate shape across a width of the clip holder body.

In another embodiment, the clip holder includes a clip member defining a strap through-opening and having a locking mechanism adapted to secure the clip member to the latch plate. In one embodiment, the connector mechanism includes an open-ended slot sized to receive the attachment handle. A clip lever attached to the clip body pivots between a first position and a second position. The clip lever has a protrusion extending from the lever portion, where the protrusion substantially closes the open-ended slot when the clip lever is in the first position and opens the open-ended slot when the clip lever is in the second position.

In another embodiment, the clip holder is part of a combination with the hard hat. In some embodiments, the combination includes a hard hat tether. In other embodiments, the combination includes a clip member adapted to be attached to the latch plate of the clip holder.

In another embodiment, the clip holder includes a connector loop extending transversely from the latch plate and defining a connector loop opening. The connector loop has a U-shape in one embodiment. In some embodiments, the connector loop is used, for example, to attach one end of a hard hat lanyard to the clip holder where the other end of the hard hat lanyard is secured to a clip member. In some embodiments, the connector loop is removably attached to the clip holder; in other embodiments, the connector loop and the clip holder comprise a unitary, monolithic member made as a single item of the same material.

In another aspect of the invention, a method of storing a hard hat tether attached to a hard hat, the method includes the steps of providing a hard hat having at least one universal accessory slot with at least one universal accessory slot having an accessory slot opening between a first slot wall and a second slot wall opposing and spaced apart from the first slot wall, and a slot rim extending along the universal accessory slot transverse to the accessory slot opening; providing a clip holder that includes a clip holder body and a latch plate adjoining and extending distally from the clip holder body, such as embodiments discussed above; providing a clip member defining a strap opening and having a locking mechanism adapted to secure the clip member to the latch plate; providing a hard hat tether having a first tether end and a second tether end; securing the first tether end of the hard hat tether to the clip member; installing the clip holder into the at least one universal accessory slot by inserting the clip holder body into the accessory slot opening with the protrusion extending therethrough with the catch surface overlapping the slot rim; and attaching the clip member to the latch plate of the clip holder.

In another embodiment, step of securing the second tether end to the hard hat includes extending the second tether end through a second universal accessory slot of the hard hat and securing the second tether end to the hard hat lanyard a predefined distance from the second tether end.

In another embodiment, the step of providing a clip holder includes selecting the clip holder to define an angle from about 120° to 180° between the latch plate and the clip holder body.

In another embodiment of a method of storing a hard hat tether, the method includes the steps of providing a hard hat; providing a tether clip system that includes a clip holder, a clip member, and a hard hat tether. The clip holder has a proximal portion, a distal portion, a front face, a rear face, and a latch opening through the clip holder that defines at least one attachment handle. The clip member defines a strap opening and has a locking mechanism constructed to removably secure the clip member to the attachment handle. The hard hat tether has a first tether end portion secured through the strap opening of the clip member, a second tether end portion, and a tether body portion secured to the clip holder. The method also includes securing the second tether end portion of the hard hat tether to the hard hat and attaching the clip member to the attachment handle of the clip holder, thereby storing the clip member In another embodiment of the method, the step of providing the hard hat includes selecting the hard hat having at least one universal accessory slot. The step of securing the second tether end portion to the hard hat includes looping the second tether end portion through the universal accessory slot of the hard hat.

In another embodiment, the method also includes selecting the hard hat having at least one universal accessory slot with an accessory slot opening between a first slot wall and a second slot wall opposing and spaced apart from the first slot wall, and a slot rim extending along the accessory slot opening and away from the accessory slot. The clip holder is selected to include a clip holder body having a proximal body end portion and a distal body end portion adjacent the latch opening, a resilient tab protruding in a first direction away from the front face of the clip holder body, a lip extending from the proximal body end portion in a second direction away from the rear face of the clip holder body and defining a distally-facing catch surface, and a connector loop extending transversely from the clip holder and defining a connector loop opening, where the clip holder body is plate-like and is constructed to be received in the universal accessory slot of the hard hat with the resilient tab abutting a first slot wall, thereby biasing the distally-facing catch surface to overlap and engage the slot rim. The method also includes inserting the clip holder body into the universal accessory slot of the hard hat with the lip extending therethrough and with the catch surface engaging the slot rim. The method further includes connecting second tether end portion through the connector loop opening of the clip holder.

These and other features, aspects, and advantages of the present invention will become better understood with regard to the following description, claims, and accompanying drawings.

DETAILED DESCRIPTION OF THE INVENTION

Figure 3:
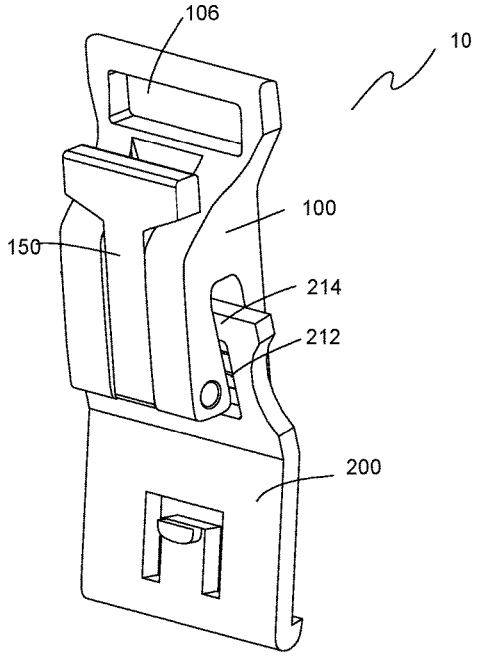
FIG. 3 is a perspective view of a tether clip system of the present invention including a clip member and a clip holder, where the locking mechanism of the clip member is in a first position and engages a recess in the clip holder's latch plate.
Figure 4:
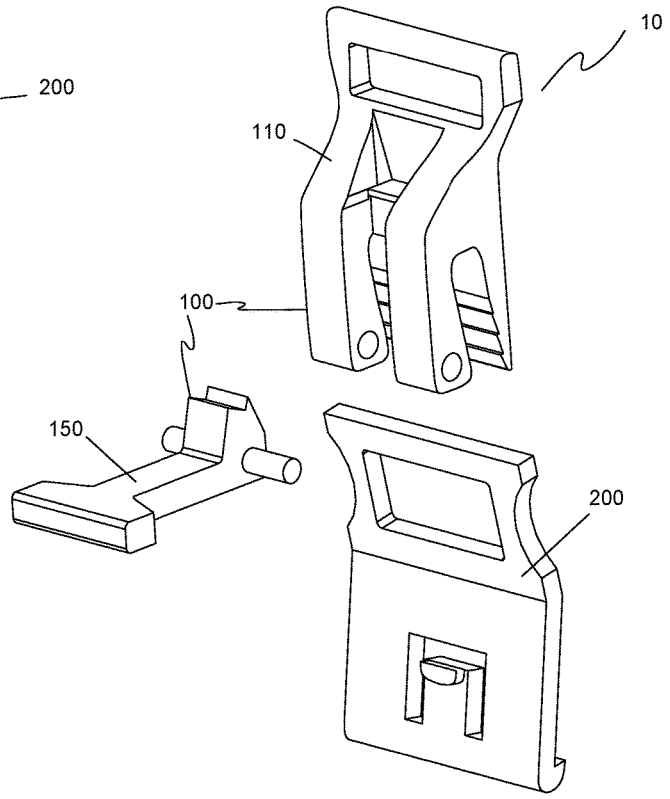
FIG. 4 is a perspective view of the tether clip system of FIG. 3 showing the clip member exploded with the locking mechanism in a second position and showing the clip member separated from the clip holder.

Embodiments of the present invention are illustrated in FIGS. 3-12. FIG. 3 is a perspective illustration of one embodiment of a tether clip system 10 that includes a clip member 100 that is releasably attachable to a clip holder 200. In FIG. 3, clip member 100 is releasably attached to clip holder 200. Tether clip system 10 is shown in a perspective view in FIG. 4 with clip member 100 separated from clip holder 200 and with components of clip member 100 shown disassembled. Clip member 100 includes a clip member body 110 and a locking mechanism 150 operably connected to clip member body 110. Locking mechanism 150 is operable between a first (closed) position (shown in FIG. 3) and a second (open) position (shown in FIGS. 4, 9B, & 10) and adapted to secure clip member 100 to clip holder 200 by capturing an attachment handle 214 of clip holder 200 with locking mechanism 150 engaging a latch recess or latch opening 212. Components of tether clip system 10 are discussed in more detail below.

Figure 5A:
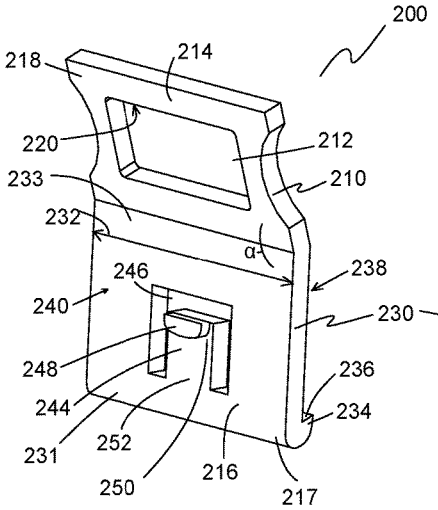
FIG. 5A is a perspective view of the clip holder of FIG. 4.
Figure 5B:
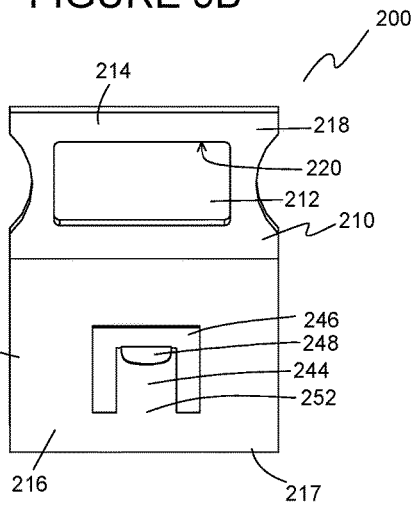
FIG. 5B is a front elevational view of the clip holder of FIG. 5A.
Figure 5C:
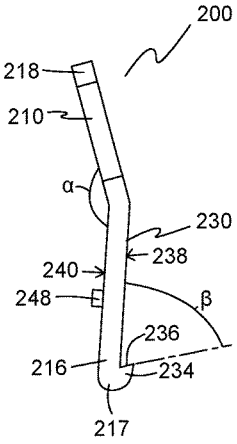
FIG. 5C is a side elevational view of the clip holder of FIG. 5A.
Figure 5D:
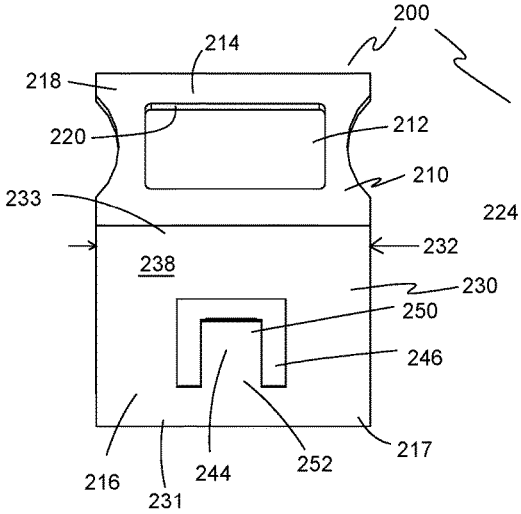
FIG. 5D is a rear elevational view of the clip holder of FIG. 5A.

Turning now to FIGS. 5A-5D, one embodiment of clip holder 200 is shown in a perspective view (FIG. 5A), a front elevational view (FIG. 5B), a side elevational view (FIG. 5C), and a rear elevational view (FIG. 5D). Clip holder 200 is a substantially flat, plate-like structure that extends from a clip holder proximal portion 216 to a clip holder distal portion 218. Clip holder 200 includes a latch plate 210 and a clip holder body 230.

Latch plate 210 has a latch opening 212 that defines an attachment handle 214. In one embodiment, attachment handle 214 is along clip holder distal portion 218. In one embodiment, latch plate 210 is substantially rectangular. Other shapes of latch plate 210 and positions of attachment handle 214 are acceptable provided that clip member 100 or other connector can attach to latch plate 210 by engaging or gripping attachment handle 214. Latch opening 212 is sized and positioned so that clip member 100 or other connector can attach to latch plate 210, for example, by receiving attachment handle 214 into or through latch opening 212 so as to be positioned to engage distal inner surface 220 of attachment handle 214. Clip member 100 is discussed in more detail below.

Clip holder 200 has a clip holder body 230 that extends from a proximal body end portion 231 to a distal body end portion 233. In some embodiments, proximal body end portion 231 is the same as clip holder proximal portion 216. Clip holder body 230 has a rear face 238 and a front face 240. Clip holder body 230 is contiguous with latch plate 210, where latch plate 210 connects to and extends distally from distal body end portion 233 of clip holder body 230. Clip holder body 230 is sized to fit into a universal accessory slot 310 of a hardhat 300 (shown in FIGS. 1-2 & 11). In some embodiments, clip holder body 230 has an arcuate shape across its width 232 that is consistent with the curvature of a hard hat brim 302.

Optionally, front face 240 of clip holder body 230 defines an angle $\alpha$ with latch plate 210 from about 120° to 180°. In one embodiment, angle $\alpha$ is about 160° to 175°, such as about 170°. When clip holder body 230 is inserted downwardly into universal accessory slot 310 of a hardhat 300 with front face 240 facing away from hard hat 300, angle $\alpha$ causes attachment handle 214 to be spaced apart from a cap portion 301 of hard hat 300 for easier access when attaching clip member 100 to clip holder 200. It is contemplated that clip holder 200 optionally may be inserted upwardly through universal accessory slot 310.

Clip holder proximal portion 216 has a lip 234 that extends in a first direction transversely away from rear face 238 of clip holder body 230. Lip 234 defines one or more catch surface 236 that faces generally towards clip holder distal portion 218. In some embodiments, clip holder body 230 has a rounded proximal end 217 that is continuous with and includes lip 234. In one embodiment, catch surface 236 defines an angle $\beta$ of 90° or less with rear face 238 of clip holder body 230. As such, catch surface 236 tends to better engage another surface without slipping, such as a slot rim 304 of brim 302 along universal accessory slot 310 of hard hat 300 (shown in FIG. 2). In one embodiment, angle $\beta$ is between about eighty and ninety degrees.

Clip holder body 230 has a flexibly resilient tab 244 that protrudes away from a front face 240 of clip holder body in a direction opposite of lip 234. In one embodiment, clip holder body 230 has a substantially U-shaped tab opening 246 that contains tab 244 with proximal tab end 252 connected to clip holder body 230. In such an embodiment, tab 244 may be substantially coplanar with clip holder body 230, in which case tab 244 includes a tab protrusion 248 that extends a predefined distance beyond front face 240. Tab protrusion 248 may be formed on, affixed to, or otherwise connected to a distal tab end portion 250. In other embodiments where tab 244 is defined by U-shaped tab opening, tab 244 is formed or caused to extend beyond front face 240 of clip holder body 230. One method of causing tab 244 to extend beyond front face 240 is to heat tab 244 to a softened or flexible state, bend tab 244 to the desired position, then quench tab 244, where tab 244 thereafter maintains the desired position. In yet other embodiments, tab 244 is a flap or piece of material that is attached to, formed on, or connected to clip holder body 230 and extending from front face 240. When clip holder 200 is installed in universal accessory slot 310 of hard hat 300 (shown in FIGS. 1-2 & 11), tab 244 extends to engage a first slot wall 314 in a state of tension, thereby biasing clip holder body 230 towards a second slot wall 316 that is opposite and spaced apart from first slot wall 314. As a result, catch surface 236 is also biased to overlap and/or engage slot rim 304 when catch surface 236 is installed through universal accessory slot 310, thereby preventing accidental removal of clip holder 200 from hard hat 300.

Figure 5E:
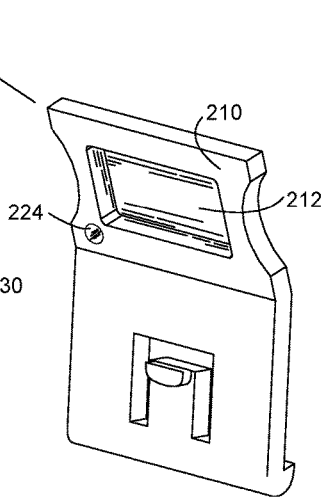
FIG. 5E is a perspective view of another embodiment of a clip holder of the present invention shown with a tether opening.

Turning now to FIG. 5E, a perspective illustration shows another embodiment of clip holder 200 that includes an optional tether opening 224. Tether opening 224 is useful for securing a first tether end 332 of hard hat tether 330 to clip holder 200. In one embodiment, tether opening 224 is a circular bore through latch plate 210 or other portion of clip holder 200 and is sized to accommodate a cable, coil, string, cord, or the like. For example, hard hat tether 330 is a polyurethane coil, where first tether end 332 is inserted through circular tether opening 224. Tether 330 is secured in tether opening 224 by attaching a crimp or fitting to first tether end 332, thereby preventing first tether end 332 from passing back through tether opening 224. In another example, hard hat tether 330 is a leather cord, where a knot tied at first tether end 332 maintains it in tether opening 224. In other embodiments, tether opening 224 is a slot or has another shape consistent with the type of hard hat tether 330 being used. As also shown in FIG. 5E, latch recess 212 that extends part way through latch plate 210 rather than being a through opening. In such an embodiment, latch recess 212 is constructed to fit between protrusion 158 of locking mechanism 150 and rear jaw 122 of clip member when locking mechanism 150 is in the first or closed position. Optionally, latch recess 212 includes gripping member 126.

Figure 6A:
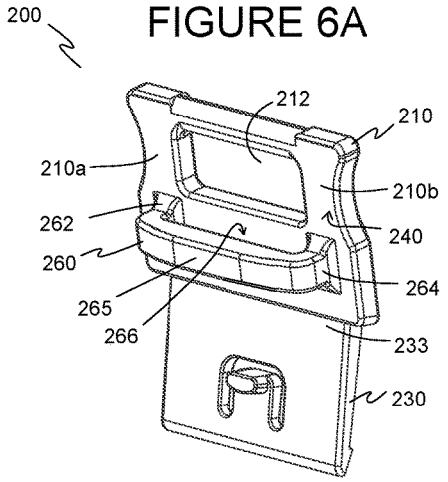
FIG. 6A is a front perspective view of another embodiment of a clip holder shown with a connector loop extending from the latch plate.
Figure 6B:
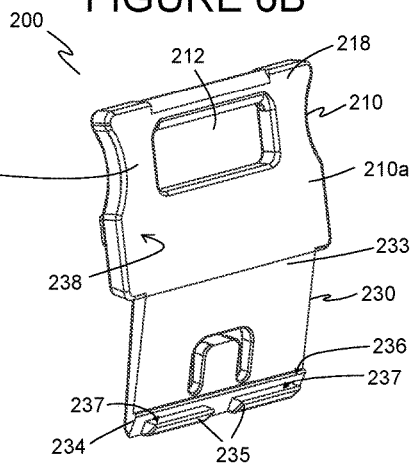
FIG. 6B is a rear perspective view of the clip holder of FIG. 6A showing a lip that includes lip protrusions.
Figure 6C:
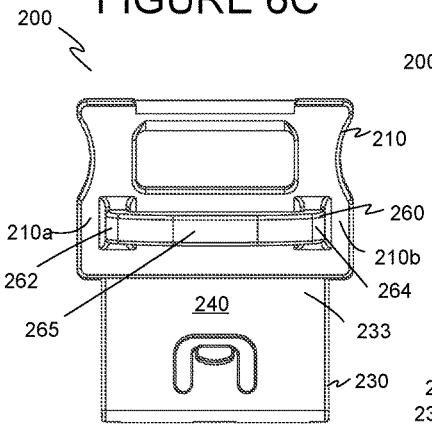
FIG. 6C is a front elevational view of the clip holder of FIG. 6A.
Figure 6D:
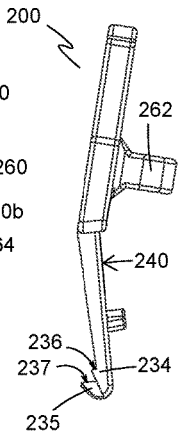
FIG. 6D is a side elevational view of the clip holder of FIG. 6A.
Figure 6E:
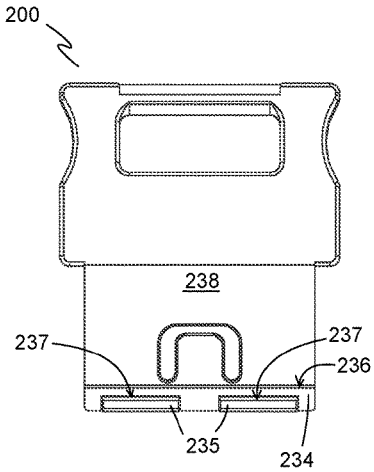
FIG. 6E is a rear elevational view of the clip holder of FIG. 6A.

Turning now to FIGS. 6A-6E, another embodiment of a clip holder 200 is shown in a front perspective view (FIG. 6A), a rear perspective view (FIG. 6B), a front elevational view (FIG. 6C), a side elevational view (FIG. 6D), and a rear elevational view (FIG. 6E). In this embodiment, clip holder 200 includes a connector loop 260 that is integrally connected to and extending transversely from front face 240. In one embodiment, connector loop 260, latch plate 210, and clip holder body 230 define a unitary, monolithic member. Connector loop 260 substantially has a U-shape with a first loop arm 262 connected to a first side portion 210*a* of latch plate 210 and a second loop arm 264 connected to a second side portion 210*b* of latch plate 210 in a spaced apart relation. A connector loop body portion 265 extends between and connects first loop arm 262 and second loop arm 264.

In one embodiment, first loop arm 262 and second loop arm 264 are each connected to latch plate 210 in a region between latch opening 212 and distal body end portion 233 of clip holder body 230. Together with latch plate 210 (or clip holder body 230, depending on location), U-shaped connector loop 260 defines a closed loop with a connector loop opening 266 that is sized to receive a portion of hard hat tether 330 therethrough. It is contemplated that connector loop 260 could also attach to rear face 238 of latch plate 210, to distal end portion 233 of clip holder body 230, or other locations on clip holder 200 provided that connector loop 260 does not interfere with insertion of clip holder 200 into universal accessory slot 310 or with attachment of clip member 100 to clip holder 200.

In use, this embodiment of connector loop 260 is useful to connect hard hat tether 330 to clip holder 200, where a portion of hard hat tether 330 (e.g., second tether end 332) is looped through connector loop opening 266. With hard hat tether 330 secured connector loop 260, latch plate 210 remains available for attaching clip member 200. Thus, clip holder 200 provides attachment handle 214 for stowing clip member 100 when it is not clipped to the user's clothing or other object as well as securing hard hat tether 330 to hard hat 300. As a result, only one universal accessory slot 310 is occupied with clip holder 200 and a hard hat's second universal accessory slot 310 is available for use with other attachments.

As shown in FIGS. 6B, 6D, and 6E, one embodiment of lip 234 includes one or more lip protrusions 235 extending from lip 234 in a direction away from rear face 238. Each lip protrusion 235 has a lip protrusion catch surface 237 that faces generally towards clip holder distal portion 218. Each lip protrusion catch surface 237 may or may not be continuous and coplanar with catch surface 236.

Figure 7A:
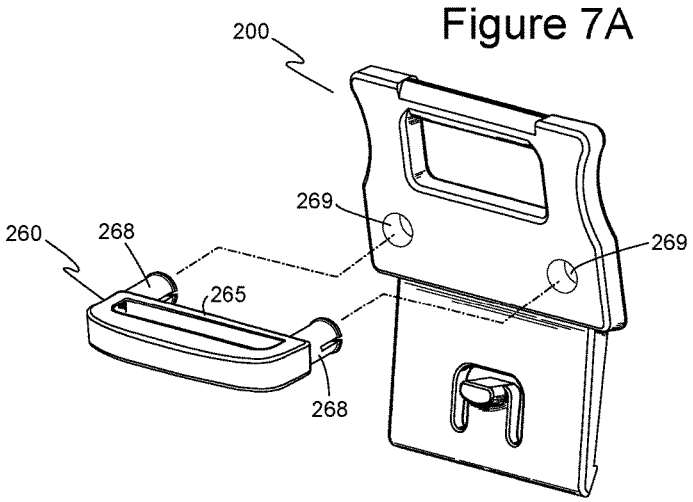
FIG. 7A is perspective view of another embodiment of a clip holder of the present invention shown with a removably attachable connector loop with connector posts.
Figure 7B:
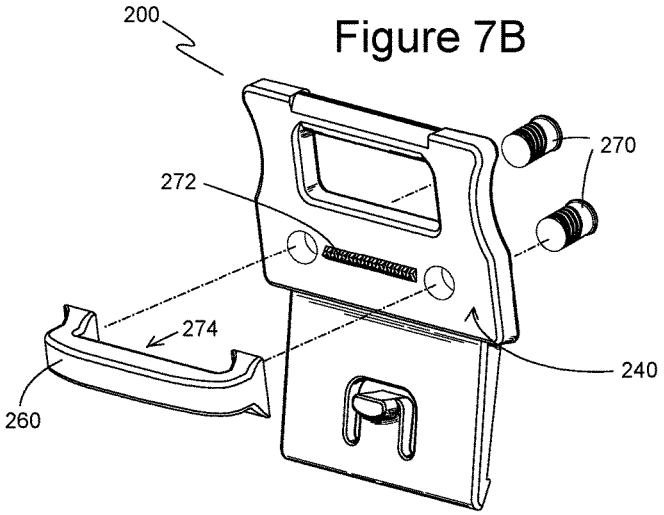
FIG. 7B is a perspective of another embodiment of a clip holder of the present invention shown with a removably attachable connector loop with fasteners.

Turning now to FIGS. 7A-7B, perspective illustrations show additional embodiments of clip holder 200. In these embodiments, connector loop 260 is removably attachable to clip holder 200. As shown in FIG. 7A, for example, connector loop 260 itself is a closed loop that includes at least one connector post 268 extending from connector loop body portion 265. Connector post(s) 268 may be a split cylindrical shaft or other type of snap-fit post or protrusion that can be received through post openings 269 and removably secure connector loop 260 to clip holder 200. In other embodiments, connector post(s) 268 are a tab, tooth, or other structure that locks with a corresponding slot, opening, catch, or the like on clip holder 200. Of course, connector post(s) 268 may extend from clip holder 200 and engage connector loop 260. In other embodiments, connector post (s) 268 is (are) threaded for use with a nut on opposite side of connector opening 269 or with threaded post opening 269. In yet other embodiments as shown for example in FIG. 7B, a fastener 270 (e.g., a machine screw) extends through each connector opening 269 to engage connector loop 260 and removably secure it to clip holder 200. Other removable attachment structures are acceptable, such as a tongue on connector loop 260 and a mating groove on clip holder 200, and other releasable locking engagement between connector loop 260 and clip holder 200.

Optionally, a plurality of teeth 272 extend from front face 240 and/or from an inside surface 274 of connector loop 260. Teeth 272 may be protrusions that are pointed, rounded, or blunt. Teeth 272 may be closely positioned adjacent one another of spread apart as appropriate for the intended use. Teeth 272 are useful, for example, when hard hat tether 330 is made of a length of webbing or the like. Teeth 272 engage and grip hard hat tether that extends through connector loop opening 266 between connector loop 260 and clip holder 200, where connector loop 260 may be snugly tightened against hard hat tether 330 to press it into teeth 272 to prevent it from slipping.

Figure 8A:
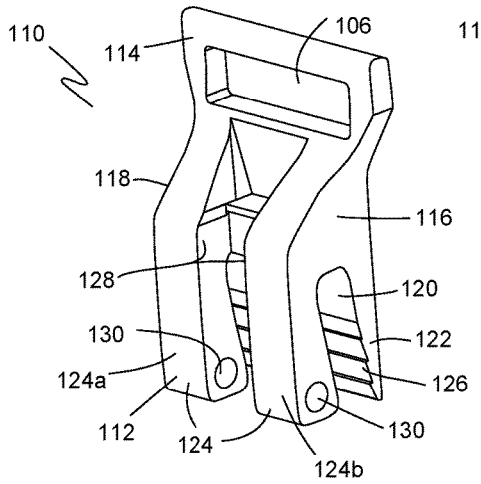
FIG. 8A is a perspective view of one embodiment of a clip body of the clip member of FIG. 3.
Figure 8B:
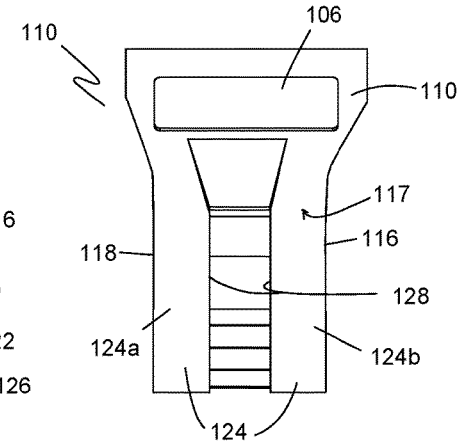
FIG. 8B is a front elevational view of the clip body of FIG. 8A.
Figure 8C:
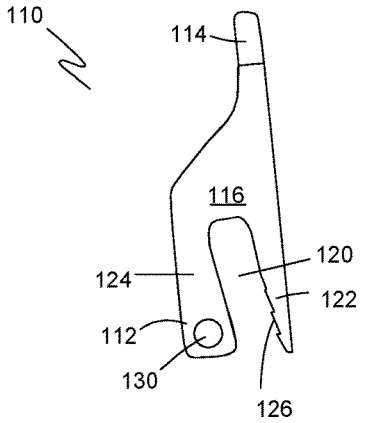
FIG. 8C is a side elevational view of the clip body of FIG. 8A.
Figure 8D:
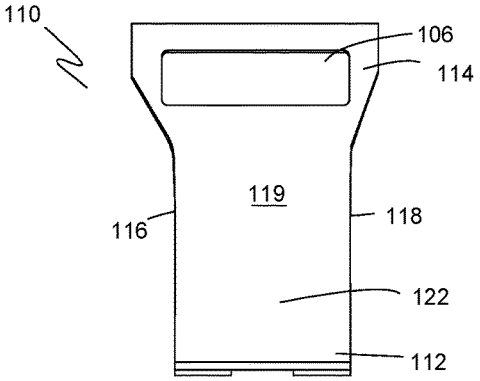
FIG. 8D is a rear elevational view of the clip body of FIG. 8A.

Turning now to FIGS. 8A-8D, one embodiment of a clip member body 110 of clip member 100 is shown in a perspective view (FIG. 8A), a front elevational view (FIG. 8B), a side elevational view (FIG. 8C), and a rear elevational view (FIG. 8D). Clip member body 110 extends between a proximal clip body portion 112 and a distal clip body portion 114. Clip member body 110 extends laterally from a first body side 116 to a second body side 118 and between front body surface 117 and rear body surface 119. Clip member body 110 defines a strap opening 106 through distal clip body portion 112. Strap opening 106 is sized for a strap, cord, coil, cable, connector, or other lanyard tether component. In one embodiment, strap opening 106 is a slot sized for a flat, flexible strap made of webbing, cloth, leather, stretchable material, or the like. Strap opening 106 may also be round or have some other shape suitable for a coupling connector, chain, cord, rope, etc. For example, strap opening 106 is a circular bore through which one end of a polyurethane coil is inserted. To secure the coil to clip member 100, a crimp is secured to the end of the polyurethane coil to prevent it from passing back through strap opening 106.

An open-ended slot 120 extends into clip member body 110 through proximal clip body portion 112 defining a rear jaw 122 and a front jaw 124 that is spaced apart from and substantially parallel to rear jaw 122. Open-ended slot 120 is sized to receive attachment handle 214 of clip holder 200. In one embodiment, open-ended slot 120 separates rear jaw 122 and front jaw 124 by about five millimeters, where attachment handle 214 has a thickness of about three millimeters. In one embodiment, open-ended slot 120 also extends laterally through one or both of first body side 116 and second body side 118 to facilitate attachment to an item that exceeds the width of clip member 110, such as clothing.

Rear jaw 122 optionally includes one or more gripping member 126, such as a ridge, tooth, protrusion, recess, groove, or other structure that facilitates clip member 100 gripping a pliable item, such as clothing or a cloth strap. In one embodiment, front jaw 124 includes a first front jaw portion 124*a* and a second front jaw portion 124*b* on opposite sides of a lever slot 128 that extends distally from proximal clip body portion 112 and through front jaw 124 to open-ended slot 120. In one embodiment, first and/or second front jaw portions 124*a*, 124*b* define a shaft bore 130 for pivotable connection of locking mechanism 150.

Figure 9A:
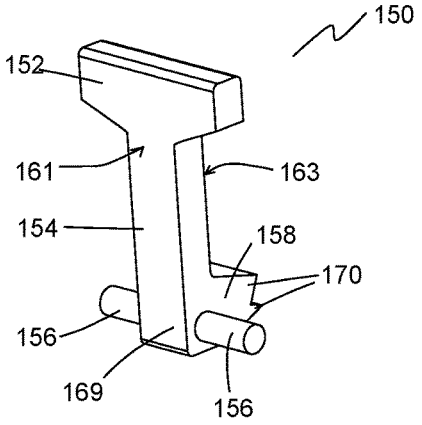
FIG. 9A is a perspective view of locking mechanism of the clip member as shown in FIG. 3.
Figure 9B:
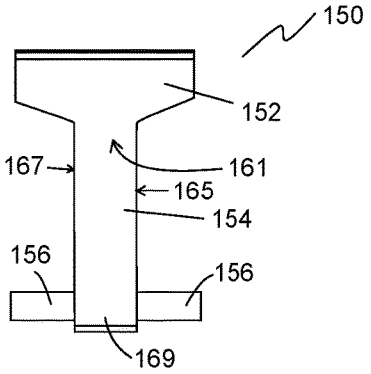
FIG. 9B is a front elevational view of the locking mechanism of FIG. 9A.
Figure 9C:
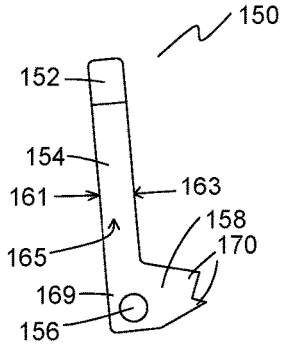
FIG. 9C is a side elevational view of the locking mechanism of FIG. 9A.
Figure 9D:
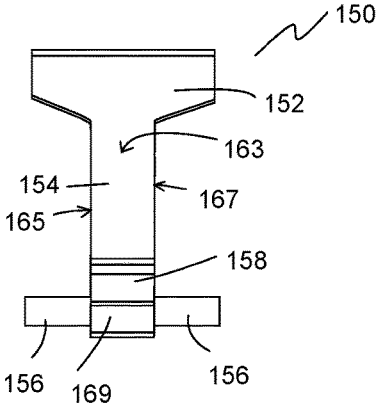
FIG. 9D is a rear elevational view of the locking mechanism of FIG. 9A.

Turning now to FIGS. 9A-9D, one embodiment of a locking mechanism 150 of clip member 100 is shown in a perspective view (FIG. 9A), a front elevational view (FIG. 9B), a side elevational view (FIG. 9C), and a rear elevational view (FIG. 9D). Locking mechanism 150 has a front surface 161, rear surface 163, first side surface 165, and second side surface 167. As shown here, locking mechanism 150 includes an optional handle portion 152, a lever portion 154, a shaft 156, and a protrusion 158. Lever portion 154 connects to and extends proximally from handle portion 152. In one embodiment, lever portion 154 and handle portion 152 define a T-shape.

One or more shafts 156 extend laterally from proximal lever end portion 160. Shaft(s) 156 is (are) sized and configured to be received in shaft bores 130 of clip member body 120 to allow locking mechanism 150 to pivot about shaft(s) 156 between a first position and a second position (shown in FIGS. 3 & 4, respectively). To facilitate assembly with clip member body 120, one or more of shafts 156 is optionally spring biased, similar to a spring pin used for a watch band. In other embodiments, first and second front jaw portions 124*a*, 124*b* are temporarily spread apart for insertion of shafts 156. In yet other embodiments, front jaw 124 or first and second front jaw portions 124*a*, 124*b* include a slot (not shown) or other opening through which shafts 156 are pressed, such as with a snap-fit.

At a proximal locking mechanism end portion 169, protrusion 158 extends transversely and in a rearward direction away from rear surface 163. Optionally, protrusion 158 includes one or more complementary gripping members 170, such as a tooth, slot, ridge, protrusion, recess, or other feature that complements gripping member(s) 126 on rear jaw 124 of clip member body 110. Complementary gripping member(s) 170 further facilitate clip member 100 in attaching to a pliable item, such as an article of clothing or the like.

Figure 10A:
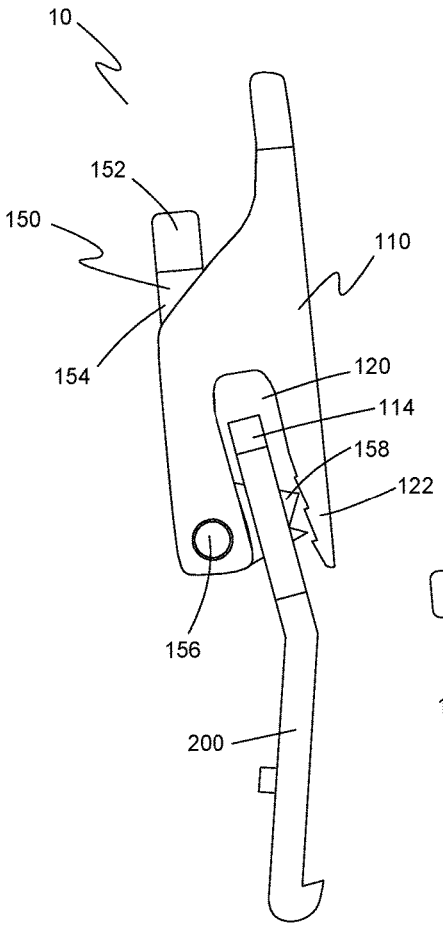
FIG. 10A is a side elevational view of the clip member of FIG. 3 showing the clip member attached to the clip holder and the locking mechanism in the first position.
Figure 10B:
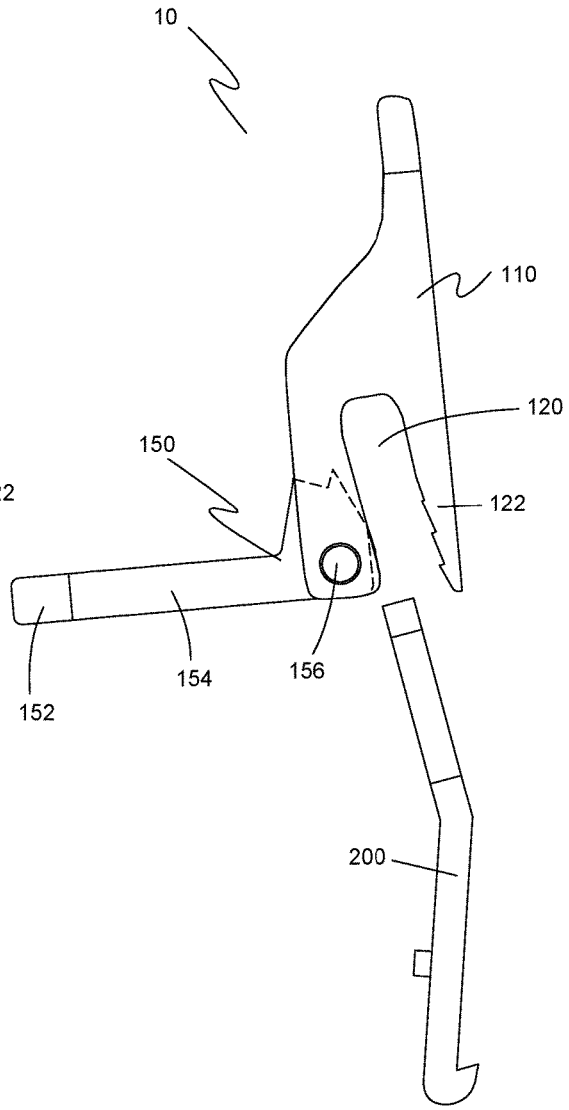
FIG. 10B is a side elevational view of the clip member of FIG. 3 showing the clip member separated from the clip holder and with the locking mechanism in the second position.

Turning now to FIGS. 10A and 10B, side views of tether clip system 10 illustrate locking mechanism 150 in a first position and in a second position, respectively. In FIG. 10A, locking mechanism 150 is in the first position where it is pivoted about shaft 156 to substantially abut and align with clip member body 110. Lever portion 152 occupies lever slot 128 (shown in FIGS. 8A & 8B) and handle portion abuts clip member body 110. In the first position, protrusion 158 extends through open-ended slot 120 towards rear jaw 122. When clip member 100 is attached to clip holder 200 with attachment handle 214 in open-ended slot 120, protrusion 158 extends into or through latch opening 212 (shown in FIGS. 8A-8C) to prohibit separation of clip member 100 and clip holder 200.

In FIG. 10B, locking mechanism 150 is in the second position where handle portion 152 has been pivoted about shaft 156 to a clip member open position away from clip member body 110. As locking mechanism 150 moves to the second position, protrusion 158 rotates out of open-ended slot 120 and into lever slot 128, thereby permitting egress and ingress of attachment handle 214 to open-ended slot 120. Accordingly, clip member 100 can be attached to or removed from clip holder 200. Similarly, when locking mechanism 150 is in the second position, clip member 100 can be installed on or removed from an article of clothing. After installing clip member 110 on an article of clothing, moving locking mechanism 150 towards or to the first position causes protrusion 158 to clamp the clothing between protrusion 158 and rear jaw 122.

Figure 1:
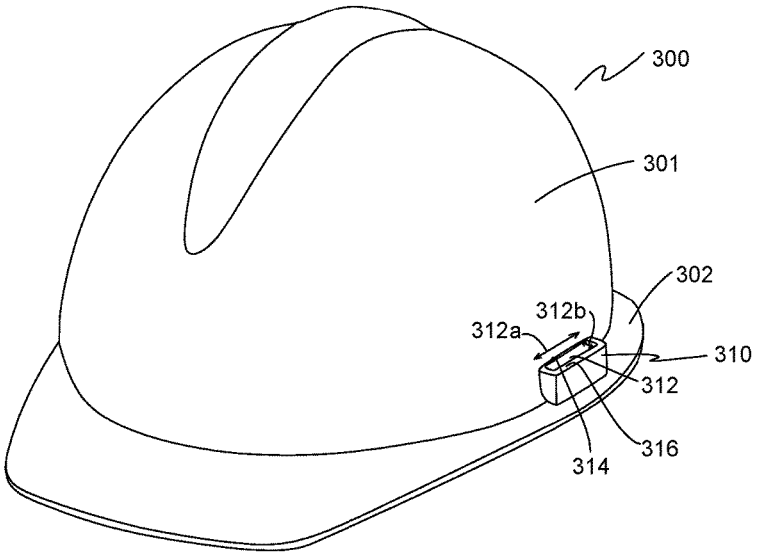
FIGURE 1 (prior art)
FIG. 1 is a perspective view of one embodiment of a hard hat of the prior art showing a universal accessory slot along the brim.
Figure 2:
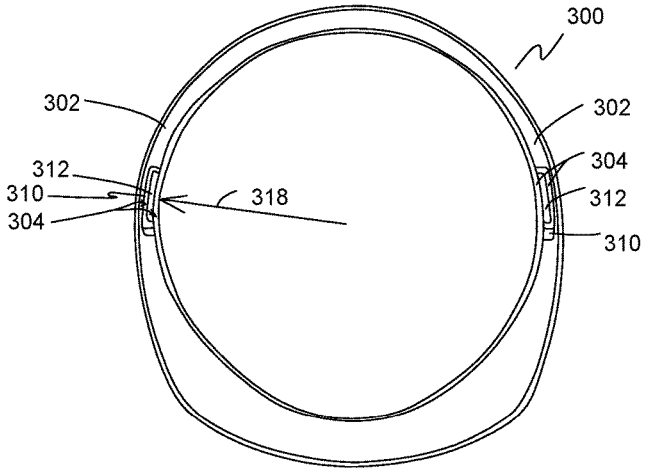
FIGURE 2 (prior art)
FIG. 2 is a bottom plan view of the hard hat of FIG. 1 showing a slot rim adjacent the accessory slot opening of each universal accessory slot.

Accessory slot openings 312 of a prior art hard hat 300 shown in FIGS. 1-2 extend through brim 302. As discussed above, catch surface 236 of lip 234 (shown in FIGS. 5A & 5C) overlaps and/or engages slot rim 304 located adjacent accessory slot opening 312 when clip holder body 230 of clip holder 200 is inserted into universal accessory slot 310 to the extent that lip 234 extends beyond slot rim 304. Brim 302 has a radius of curvature 318, typically about ten centimeters.

Figure 11:
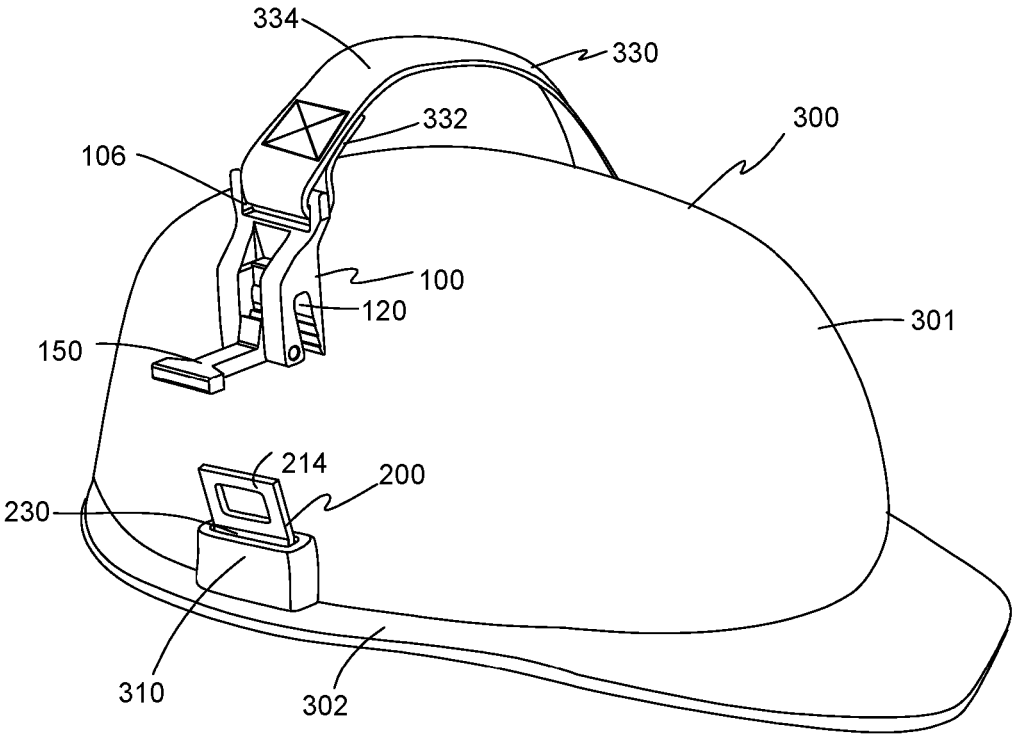
FIG. 11 is a perspective illustration of one embodiment of a tether clip system of the present invention showing the clip holder installed in the universal accessory slot and the clip member connected to a hard hat tether are ready for attachment to the clip holder.

Turning now to FIG. 11, a perspective illustration shows a portion of hard hat 300 with an embodiment of tether clip system 10. Clip holder 200 has clip holder body 230 installed in universal accessory slot 310 and locked in place with lip 234 overlapping and/or engaging slot rim 304 (not visible). Clip member 100 has locking mechanism 150 in the first (open) position and is capable of attaching to clip holder 200 by capturing attachment handle 214 in open-ended slot 120. A hard hat tether 330 has a first tether end 332 looped through strap opening 106 and secured to tether body 334. Tether body 334 extends over cap portion 301 with a second tether end 336 connected to hard hat 300, such as having second tether end 336 looped through a second universal accessory slot 310 (not visible) or otherwise secured to hard hat 300.

The various embodiments of clip holder 200 provide installation and use options to the user. For example, in one embodiment, clip holder 200 includes clip holder body 230 as shown in FIGS. 5A-5D. The user installs clip holder 200 by inserting clip holder body 230 into one universal accessory slot 310. First tether end 332 is secured to clip member 100 and second tether end 336 is attached to hard hat 300 at another location (e.g., connected by a snap button to hard hat 300) where a second universal accessory slot 310 remains available for other hard hat attachments.

In another example, a pair of clip holders 200 is used, where each clip holder 200 has clip holder body 230 installed in a universal accessory slot 310 on opposite sides of hard hat 300. First tether end 332 is secured to clip member 100, which can be attached to clip holder 200 on one side of hard hat 300. Second tether end 336 is looped through latch opening 212 of the opposite clip holder 200. Thus, one clip holder 200 secures second tether end 336 and another clip holder 200 is used for storing clip member 100 when it is not in use.

In yet another example, clip holder 200 shown in FIGS. 6A-6E is installed in one universal accessory slot 310 of hard hat 300. Second tether end 336 is looped through connector loop 260 to secure hard hat tether 330 to hard hat 300. First tether end 332 is secured to clip member 100, which may be attached to latch plate 210. Thus, a single clip holder 200 is used both for securing hard hat tether 300 to hard hat 300 as well as stowing clip member 100 when it is not in use. In other embodiments, clip holder 200 lacks clip holder body 230 and is attached to hard hat tether 330 rather than being installed in universal accessory slot 310.

Figure 12:
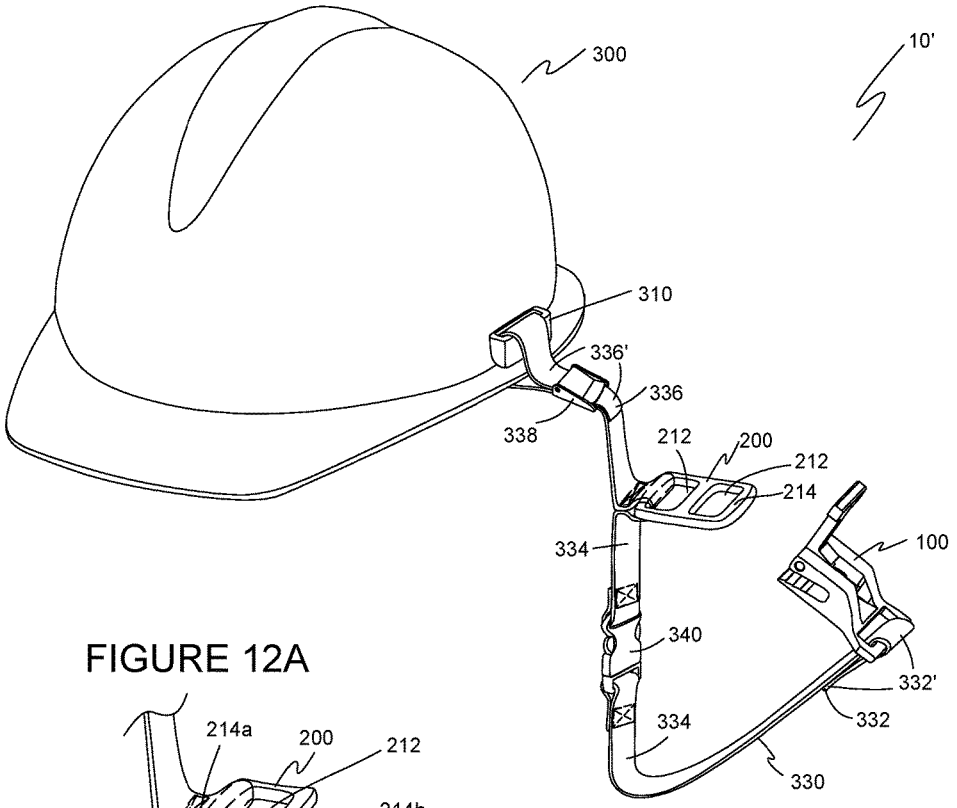
FIG. 12 is a perspective illustration of another embodiment of a tether clip system of the present invention showing the clip member attached to the end of a hard hat tether and another embodiment of a clip member secured to a portion of the tether towards the hard hat.

Turning now to FIG. 12, a perspective illustration shows hard hat 300 and hard hat tether 330 as part of another embodiment of a tether clip system 10'. Hard hat tether 330 includes clip member 100 attached to first tether end 332 and clip holder 200 secured to tether body 334 or second tether end portion 336'. One embodiment of clip holder 200 is a generally flat plate of plastic or other suitable material with one or more latch openings 212 therethrough that define one or more attachment handle 214 for attachment by clip member 100. As shown in FIG. 12, clip holder 200 has two latch openings 212. Latch opening(s) 212 are sized to provide sufficient space between attachment handle 214 and adjacent structure of tether holder 200 so that attachment handle 214 can be received in and captured in open-ended slot 120 of clip member 100 without being caught between gripping member 126 of clip member 100 and protrusions 158 of locking mechanism.

Figure 12A:
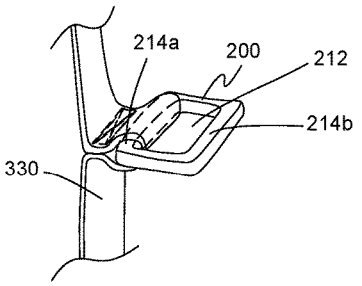
FIG. 12A is a perspective illustration of part of a hard hat tether shown secured to one embodiment of a clip holder.

As shown in FIG. 12A, some embodiments of clip holder 200 have the general shape of a closed rectangular loop with a single latch opening 212 that defines first and second attachment handles 214*a*, 214*b* on opposite sides of latch opening 212. For example, hard hat tether 330 is looped around first attachment handle 214*a* and secured to itself to capture and retain clip holder 200 at a location along hard hat tether 330 while second attachment handle 214*b* is available for clip member 100 to attach.

Second tether end portion 336' of hard hat tether 330 is secured to hard hat 300 by being installed through universal accessory slot 310 and fixed to itself or to tether body 334. Alternately second tether end portion 336' is stitched to or otherwise fixedly attached to itself or tether body 334 after passing through universal accessory slot 310. Examples of methods of fixing second tether end portion 336 include tying it to tether body 334, folding it and stitching it to itself, using a snap, rivet, clamp, cam buckle, webbing slider, or other hardware device 338 to secure second tether end portion 336' to itself or to tether body 334 to prevent second tether end 336 from passing back through universal accessory slot 310.

Optionally, hard hat tether 330 includes a buckle clip or other releasable connecting hardware 340 installed along tether body 334 between first tether end portion 332' and second tether end portion 336'. In the event of damage to tether components or the desire to use a different clip member 100, releasable connecting hardware 340 allows the user to remove and replace a section of hard hat tether including clip member 100. Similarly, a section of hard hat tether 300 including first end portion 336' and clip holder 200 may be removed and replaced. Examples of releasable connecting hardware 340 include snap buckles, hooks, carabiners, chain links, snap clips, clasps, and the like.

One method of storing a hard hat tether 330 attached to a hard hat 300 will now be explained. A user obtains a tether clip system 10 that includes a clip member 100, a clip holder 200, and a hard-hat tether 330. Clip member 100 has a clip member body 110 and releasable locking mechanism 150 that allows clip member 100 to releasably grip and/or capture attachment handle 214 of clip holder 200. Clip member 100 is also constructed to releasably grip and firmly hold an article of clothing, safety harness webbing, or other equipment/clothing worn by the user. In one embodiment, clip member 100 is an embodiment described above where locking mechanism 150 includes a lever-operated protrusion 158. In other embodiments, clip member 100 is a spring clip, suspender clip, or other clip known in the art. In one embodiment, the user selects a tether clip system 10 with first tether end 332 secured through strap opening 106 of clip member 100.

Clip holder 200 includes clip holder body 230 constructed to fit into and engage universal accessory slot 310 of hard hat 300. In such an embodiment, clip holder 200 is installed into universal accessory slot 310 of a hard hat 300 with clip holder body 230 extending into accessory slot opening 312 to the extent that lip 234 extends past and overlaps slot rim 304, thereby locking clip holder 200 in universal accessory slot 310. On some hard hats 300, slot rim 304 is located on an underside of brim 304. In another embodiment, slot rim 304 is located above an upper side of brim 304 adjacent cap portion 301, where clip holder 200 is inserted in an upward direction through universal accessory slot 310.

Second tether end 336 of hard hat tether 330 is secured to hard hat 300. In one embodiment, second tether end 336 is secured by looping through another universal accessory slot 310 on hard hat 300. Alternately, second tether end 336 is connected to the hard hat's suspension harness, through some other opening in hard hat 300, or to a connector (not shown) attached to hard hat 300.

When clip member 100 is not being used to secure hard hat tether 330 to the user's clothing, clip member 100 is attached to clip holder 200 by inserting latch plate 210 into open-ended slot 120. Clip member is then secured to clip holder 200 by moving locking mechanism 150 to the first (closed) position while maintaining latch plate 210 in open-ended slot 120.

Another method of storing a hard hat tether 330 attached to a hard hat 300 will now be explained. As with the method discussed above, the user obtains a tether clip system 10 that includes a clip member 100, a clip holder 200, and a hard-hat tether 330. Clip member 100 has a clip member body 110 and releasable locking mechanism 150 that allows clip member 100 to capture attachment handle 214 of clip holder 200 as well as to releasably grip and tightly hold an article of clothing, safety harness webbing, or other equipment/clothing worn by the user. In other embodiments, clip member 100 is a spring clip, suspender clip, or other clip. In one embodiment, the user selects a tether clip system 10 with first tether end 332 secured through strap opening 106 of clip member 100. In other embodiments, the user installs first tether end 332 through strap opening 106 and secures it so itself or to tether body 334 to securely attach clip member 100 to hard hat tether 300.

Clip holder 200 is selected to include at least one latch opening 212 defining at least one attachment handle 214 for attachment by clip member 100. For example, clip holder 200 is an embodiment as described above with reference to FIGS. 12-12A. In one embodiment, hard hat tether 330 is selected with clip holder 200 securely attached to tether body 334 near second tether end 336. For example, clip holder 200 is secured to hard hat tether 330 by looping through latch opening 212 and stitching tether body 334 to itself, where clip holder 200 is positioned about three to eight inches from second tether end 336 so that clip holder 200 hangs no more than six inches below brim 302 when hard hat 300 is worn by the user. Preferably, clip holder 200 is positioned along hard hat tether 330 so as to be no more than one to two inches from brim 302.

Second tether end 336 of hard hat tether 330 is secured to hard hat 300 by looping it through universal accessory slot 310 of hard hat 300 and securing it to tether body 334 or second tether end portion 336'. Alternately, second tether end portion 336' is connected to the hard hat's suspension harness, through some other opening in hard hat 300, or to a connector (not shown) attached to hard hat 300.

After disengaging clip member 100 from the user's clothing or equipment, clip member 100 is attached to attachment handle 214 of clip holder 200 by inserting attachment handle 214 into open-ended slot 120 of clip member 100. Clip member 100 is then secured to clip holder 200 by moving locking mechanism 150 to the first (closed) position, thereby capturing attachment handle 214 in open-ended slot 120.

Methods of storing a hard hat tether discussed above have the advantage of convenience and safety for the user. When clip member 100 on first end 332 of hard hat tether 330 is stored as discussed above, hard hat tether 330 is less prone to catching on equipment and the like and is more convenient when storing the hard hat since first tether end 332 does not hang down as far from hard hat 300.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

The invention claimed is:

1. A method of storing a hard hat tether attached to a hard hat, the method comprising:

providing a hard hat;

providing a tether clip system comprising:

a clip holder having a latch plate with a latch opening that defines at least one attachment handle;

a clip member defining a tether opening and having a locking mechanism constructed to removably secure the clip member to the clip holder by capturing the at least one attachment handle of the clip holder; and a hard hat tether having a first tether end portion secured through the tether opening of the clip member, a second tether end portion adapted for securing to the hard hat, and a tether body portion secured to the clip holder;

securing the second tether end portion to the hard hat; and attaching the clip member to the attachment handle of the clip holder, thereby storing the clip member.

2. The method of claim 1, wherein the hard hat has at least one universal accessory slot; and the step of securing the second tether end portion to the hard hat includes looping the second tether end portion through the universal accessory slot of the hard hat.

3. A method of storing a hard hat tether attached to a hard hat, the method comprising:

providing a hard hat having a universal accessory slot with an accessory slot opening between a first slot wall and a second slot wall opposed to and spaced apart from the first slot wall, and a slot rim extending along the accessory slot opening;

providing a clip holder comprising:

a clip holder body having a proximal body end portion and a distal body end portion, a front face, and a rear face, the clip holder body comprising:

a resilient tab protruding in a first direction away from the front face of the clip holder body; and a lip extending from the proximal body end portion in a second direction away from the rear face of the clip holder body, the second direction being substantially opposite of the first direction; wherein the lip defines a catch surface;

wherein the clip holder body is plate-like and sized to be received through the at least one universal accessory slot of the hard hat with the resilient tab abutting the first slot wall and the lip overlapping the slot rim; and a latch plate adjoining and extending distally from the distal body end portion of the clip holder body, the latch plate having a latch opening extending therethrough and defining an attachment handle;

providing a clip member defining a tether opening and having a locking mechanism adapted to secure the clip member to the latch plate;

providing a hard hat tether having a first tether end secured to the clip holder and a second tether end secured to the tether opening of the clip member;

installing the clip holder into the universal accessory slot by inserting the clip holder body into the accessory slot opening with the resilient tab extending therethrough with the catch surface overlapping the slot rim; and attaching the clip member to the clip holder.

4. The method of claim 3 wherein the step of attaching the clip member to the clip holder includes attaching the clip member to the latch plate of the clip holder, thereby storing the clip member.

5. The method of claim 3, wherein the latch plate is angled toward a front face of the clip holder body.

6. The method of claim 5, wherein the clip holder body defines an angle with the latch plate in the range of 120 to 180 degrees.

7. The method of claim 3, wherein the latch opening is rectangular shaped.

8. The method of claim 3, wherein the catch surface defines an angle of 90 degrees or less with the face of the clip holder body.

9. The method of claim 1, wherein the clip holder has a rounded proximal end.

10. The method of claim 1, wherein the latch plate is angled toward a front face of the clip holder body.

11. The method of claim 10, wherein the clip holder body defines an angle with the latch plate in the range of 120 to 180 degrees.

12. The method of claim 1, wherein the latch opening is rectangular shaped.

13. The method of claim 1, wherein the clip holder has a rounded proximal end.

14. The method of claim 1, wherein the clip holder has a flexibly resilient tab that protrudes away from a front face of the clip holder.

15. The method of claim 1, wherein the latch plate completely surrounds the latch opening.

* * * * *